US008721848B1

(12) United States Patent
Simpson

(10) Patent No.: US 8,721,848 B1
(45) Date of Patent: May 13, 2014

(54) ANODE SLED AND METHOD OF ASSEMBLY

(71) Applicant: Marine Project Management Inc., Ojai, CA (US)

(72) Inventor: Steven M. Simpson, Ojai, CA (US)

(73) Assignee: Marine Project Management, Inc., Ojai, CA (US)

( * ) Notice: Subject to any disclaimer, the term of this patent is extended or adjusted under 35 U.S.C. 154(b) by 26 days.

(21) Appl. No.: 13/796,191

(22) Filed: Mar. 12, 2013

Related U.S. Application Data

(60) Provisional application No. 61/747,440, filed on Dec. 31, 2012.

(51) Int. Cl.
*C23F 13/06* (2006.01)
*C23F 13/18* (2006.01)

(52) U.S. Cl.
USPC ..... 204/196.3; 204/196.01; 405/211.1; 405/222

(58) Field of Classification Search
USPC ..... 204/196.3
See application file for complete search history.

(56) References Cited

U.S. PATENT DOCUMENTS

| | | | | |
|---|---|---|---|---|
| 3,662,559 | A * | 5/1972 | Swift | 405/225 |
| 4,664,556 | A * | 5/1987 | Dixon | 405/223 |
| 5,593,623 | A * | 1/1997 | Mohss | 264/32 |
| 5,829,915 | A * | 11/1998 | Andreassen | 405/18 |
| 6,461,082 | B1 | 10/2002 | Smith | |
| 7,329,336 | B2 | 2/2008 | Britton | |
| 2008/0101862 | A1 * | 5/2008 | Mountain | 405/18 |
| 2011/0000794 | A1 * | 1/2011 | Nelvig et al. | 205/726 |
| 2012/0305386 | A1 * | 12/2012 | Schutt | 204/196.38 |

OTHER PUBLICATIONS

BAC Technical Data Sheet 1.1-1 "Pre-Packaged Magnesium Anode" available online on Sep. 15, 2011.*
Webpage copyright 2012 http://www.sea-struct.com.au/productlisting/products/stabilised-base-pyramids.aspx.
Webpage copyright 2012 http://www.sea-struct.com.au/productlisting/products/gm-series-groutbags.aspx.

* cited by examiner

*Primary Examiner* — Bryan D. Ripa
(74) *Attorney, Agent, or Firm* — Ralph D. Chabot

(57) ABSTRACT

An anode sled for assembly is disclosed which is constructed using a bag or sack which can be filled on-site with ballast. The sled design includes at least one stanchion or post extending upward from the sack and supports an anode. The sled can be used for both sacrificial anode and impressed current applications.

14 Claims, 4 Drawing Sheets

FIG. 2
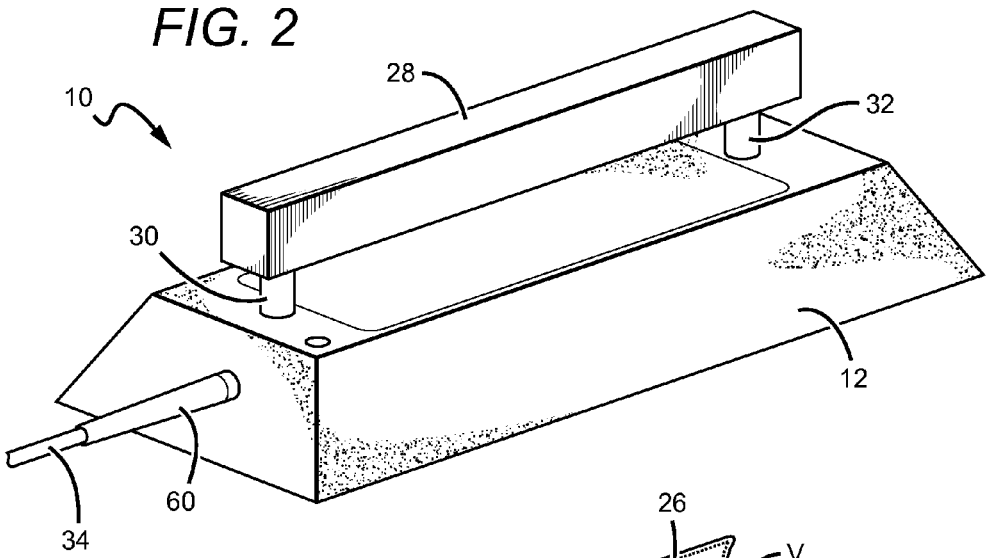
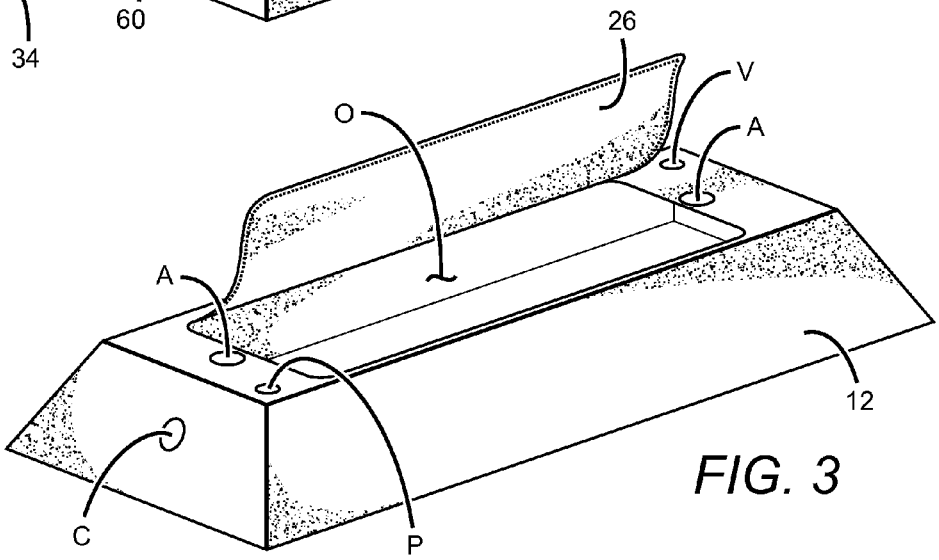
FIG. 3
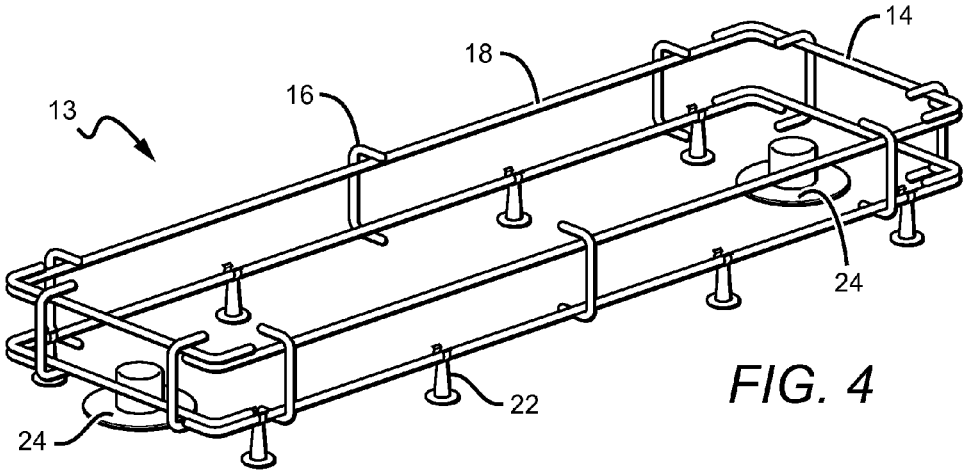
FIG. 4

ANODE SLED AND METHOD OF ASSEMBLY

FIELD OF THE INVENTION

This invention relates generally to cathodic protection systems and more particularly cathodic protection systems for protecting metallic structures from seawater corrosion.

BACKGROUND OF THE INVENTION

When cathodic protection is used to protect structures positioned in a water environment, a variety of sacrificial and impressed current anode systems can be utilized. Generally, impressed current anode systems are used for applications where higher amperages are required to achieve the desired level of cathodic protection while sacrificial anode systems, usually made from zinc or aluminum, corrode to produce the electron flow that protects the steel structure from corrosion.

Anodes have a higher efficiency when positioned in the water, above the sea floor and sediment rather than buried beneath.

The term "sea floor" is used to describe the solid surface underlying a body of water such as, for example, oceans, seas, harbors, lakes, estuaries, etc.

Many methods have been described in the prior art which utilize one or more anode(s) to protect metallic underwater structures from corrosion. Anodes positioned on the sea floor are typically mounted on structures constructed from concrete, steel and or fiberglass. These structures are oftentimes referred to as "sleds". Sleds are utilized to ensure that the anode(s) remain above the mudline or soft sediment deposited upon the sea floor. The sled design may also incorporate features including: a structural attachment for the anode and anode power cable, a mounting point for power cable(s) junction box, or ballast (mass/weight) to eliminate physical movement or overturning in high velocity current environments or during storm events, and protection from fishing equipment or objects that have been dropped from the surface.

For impressed current cathodic protection, the prior art anodes are connected to one or more cables, and because of the shape and construction of the anodes, the connection to the cables generally must be done in a factory before the anode is mounted to the sled. Typically, the concrete weight and support material must be cast before the anode assembly is shipped from the factory. The requirement to connect the cable and possibly cast the concrete increases the cost and shipping of the sled.

Similarly, for cathodic protection using sacrificial anodes, the design is based upon the surface area of the anode exposed to the water. Cables are then used to connect the sacrificial anode to the subsea structure.

One example of a marine system using sacrificial anodes for cathodic protection is U.S. Pat. No. 6,461,082. A plurality of sacrificial anodes are positioned on top of an elongated electrode carrier, such as a long pipe which is laid upon the seafloor. Each anode is attached to the pipe and the pipe is thereafter operably connected to the structure. In order to maximize the surface area of the anode exposed to the water, this invention requires an additional supporting structure such as a mud mat on the seafloor so that the pipe will not sink into the mud and cover the pipe and anodes.

Another example of a marine system using sacrificial anodes for cathodic protection is U.S. Pat. No. 7,329,336. A plurality of blocks spaced apart and connected by wire rope is used as a seafloor mat. Each block is filled with concrete and at least one of the blocks has embedded in it a sacrificial anode. The anode is embedded so that only the top surface of the anode is exposed for contact with the water. The blocks allow for the concrete to be poured at surface on-location; thus significantly reducing transportation costs associated with loading, hauling and unloading ballast filled blocks. However, because only the top surface of an anode is available for contact with water, surface area is compromised and it is necessary to include many more blocks having the embedded anode to achieve the same level of protection as an anode having substantially its entire surface area exposed to the water.

One example of a marine system using impressed current for cathodic protection is described in U.S. Patent Application Publication No. US 2012/0305386. This anode assembly includes a spherical anode, a vertical anode support structure and a weighted base which is hollow and made of a fiberglass shell. The lower end of the anode support structure is disposed within the hollow base which is thereafter filled with concrete.

Manufacturing and shipping costs for a state-of-the-art "anode sled" are very high, due to the materials employed and the required size of the sled.

Subsea corrosion protection can incorporate the use of fiberglass sled structures to support anode(s) above the seabed as manufactured by Marine Project Management, Inc., Ojai, Calif. (www.mpmi.com). Another method is to utilize a steel structure to support anodes which is basically a framework which lies on the sea floor as manufactured by Deepwater Corrosion Services, Inc., Houston, Tex. (www.stoprust.com). Both types of structures mentioned are expensive to fabricate and ship, and require a significant lead time to manufacture and deliver.

Grout bags have been used for many years for supporting underwater pipeline spans and are intended to be pumped full of cement grout once in place underwater. A typical grout bag is one provided by SEA STRUCT Pty Ltd, North Fremantle, Australia (www.sea-struct.com.au). These devices are more specifically used for supporting an underwater pipeline in areas where the pipe is suspended above the sea floor for a length which could cause the pipeline to buckle. Grout bags are structural in nature and are placed along a spanning pipeline to reduce the span length and are not related to anodes or cathodic protection.

SUMMARY OF THE INVENTION

My invention is a sled which can be assembled off-shore or nearby the drop point thereby eliminating the need to transport ballast filled sleds or use bulky pre-formed block shells long distances. In simplest terms, my sled is constructed using a bag or sack which can be filled with ballast. My sled design includes at least one stanchion or post extending upward from the sack and supports an anode; preferably integral with the anode. The sled can be used for both sacrificial anode and impressed current applications.

By using a bag structure, the sled can be fabricated on-site and then filled with ballast such as concrete. Overall manufacturing, shipping and handling costs can be reduced by up to 75% when compared to prior art sled designs.

The anode sled comprises a bag which was previously in a compacted condition such as flat, rolled or folded. The term "compacted condition" means a volume of space which is less than the volume of the bag when filled. The bag has a top surface, and a closable opening. When open, the closable opening has an aperture of sufficient size for insertion into the bag of a skeletal support structure. The closable opening can comprise a flap that can be attached on its perimeter to the adjacent bag surface using any means including, but not limited to zipper, Velcro®, stitching, etc. The bag also has at least one aperture located on the top surface for receiving through a respective post.

When disposed within the bag, the skeletal structure provides support to the ballast which fills the interior of the bag. Use of the phrase "fills the interior of the bag" includes the possibility that a de minimus amount of air may remain in the bag after the filling process. So long as a sufficient amount of ballast is present in the bag to perform its function as a sled, the bag is considered filled. Also, optionally are respective post bases having a wider diameter footprint for providing stability for each post while the bag is filled with ballast. The top portion of the post extends upward from a respective aperture located on the top surface of the bag.

Although at least one post supports the anode positioned above the bag's top surface, preferably, two posts are used for structural support.

In comparison to the use of pre-fabricated hollow blocks which can be filled with ballast, the bag of the present invention can be shipped in a compacted condition, thus taking up a fraction of the space required for blocks or other designs having pre-formed rigid outer walls. Preferably, the bag used is lightweight, tear-resistant and made of a pliable or flexible material. By way of example, the bag could be made of burlap, cloth, soft plastic or any other material one having skill in the art could use for filling with ballast. The bag can be made of any material so long as it is sufficiently durable to withstand being filled with ballast.

The bag can be manufactured in various widths, lengths and heights depending on both the anode size to support and the sea floor soil composition. By way of example, if the desired placement location has a significant soft sediment layer, a bag will be selected having a higher vertical dimension and wider horizontal dimension than a location having only a minimal layer of soft sediment. A primary concern is to utilize a sled design which will have a low center of gravity to prevent the sled from tipping over.

As described earlier, the sled incorporates a skeletal structure comprising reinforcing elements which can be assembled on-site, and positioned within the bag. Thus, the bag has a sufficient closable opening for insertion of the reinforcing elements.

For each post present, a corresponding post aperture is present on the top surface of the bag and the aperture is slightly larger than the outer circumference of the post. The composition of the post will depend on the specific anode type used as is well known to those having ordinary skill in the art.

Once the skeletal structure and the lower portions of each post are positioned within the bag via a respective aperture, the bag is filled with ballast such as concrete. Depending upon the bag design utilized, concrete may be poured into the opening prior to closure. Alternatively, there may be an additional, smaller port provided on the bag for adding ballast.

Depending upon how the anode is to be operatively connected, the proximal end of the cable may be directly connected to the anode and run outside of the sled. Alternatively, the anode may be operatively connected to the proximal end of the cable running through an opening in the bag and operatively attached to the anode prior to the sack being filled with ballast using methods well known to those skilled in the art. The cable is of a pre-determined length sufficient for the cable's distal end to be operatively connected to the metallic structure requiring cathodic protection.

Having described the parts of my sled, a typical method of assembly will now be described for a sled having two posts for supporting an anode.

The bag, anode, posts, and supporting hardware will be shipped to the location site.

The components used to form the skeletal structure can be assembled on-site. The term "on-site" means above the water surface on a platform, ship, or onshore nearby.

Depending upon how the bag is shipped to the assembly site, the bag will be unrolled or unfolded and positioned so that the bag surface having the opening faces upward.

The skeletal support structure is inserted through the closable opening into the bag.

Both posts are inserted into the bag and the bottom portion of each post passes through a respective aperture located on the top side of the bag so that the base of each post rests on the bottom surface of the bag, preferably nested in a support base. The top portion of each post extends upward and away from the bag with the anode integrally connected to both posts and parallel to the top surface of the bag.

If the cable connection is to a post section located within the bag, a hole is either provided as part of the original bag design or can be cut on location. The proximal end of the cable is then run into the bag through the hole and then operatively attached to the post before the bag is filled with ballast. The cable will be of a pre-determined length sufficient for the distal end of the cable to be operatively connected to the metallic structure requiring cathodic protection. In a preferred embodiment particularly for impressed current cathodic protection systems, the physical cable connection can then be encased in urethane or similar product to prevent water intrusion in accordance with well know procedures to those having ordinary skill in the art.

The opening is then closed and the bag filled with ballast using an inlet port provided on the bag and optionally the addition of a port for venting air while filling. In a preferred embodiment, elephant trunks are used as part of the bag design for each respective opening for the posts, cable, and the ballast inlet and venting outlets. A tying device such as tie rods or the like are utilized to prevent ballast from escaping before it can cure. Once filled with ballast, the bag is now termed a sled.

After the ballast is allowed to set, the sled can be lowered into the water and positioned as desired. The location for final position of the sled is in accordance with well-known procedures to those having ordinary skill in the art.

In its final resting position, the distal end of the cable is operably connected to the metallic structure or electrical system intended for cathodic protection by divers or remote operated vehicles using methods well known.

My method, besides being a significant savings over prior art methods, is designed to serve two primary functional purposes. First, to locate the final position of the anode above the mudline of the seafloor and second, to provide sufficient weight to serve as an anchor, thus preventing any movement of the anode during the anode's life.

DESCRIPTION OF THE DRAWINGS

FIG. 2 is an assembled anode sled according to one embodiment of the invention.

FIG. 3 illustrates the closable opening on the top surface of a bag.

FIG. 4 is the assembled skeletal structural support for the interior of the sled bag.

DETAILED DESCRIPTION OF THE PREFERRED EMBODIMENT

The figures are provided for illustration purposes and are not necessarily to be drawn to scale.

Figure 1:
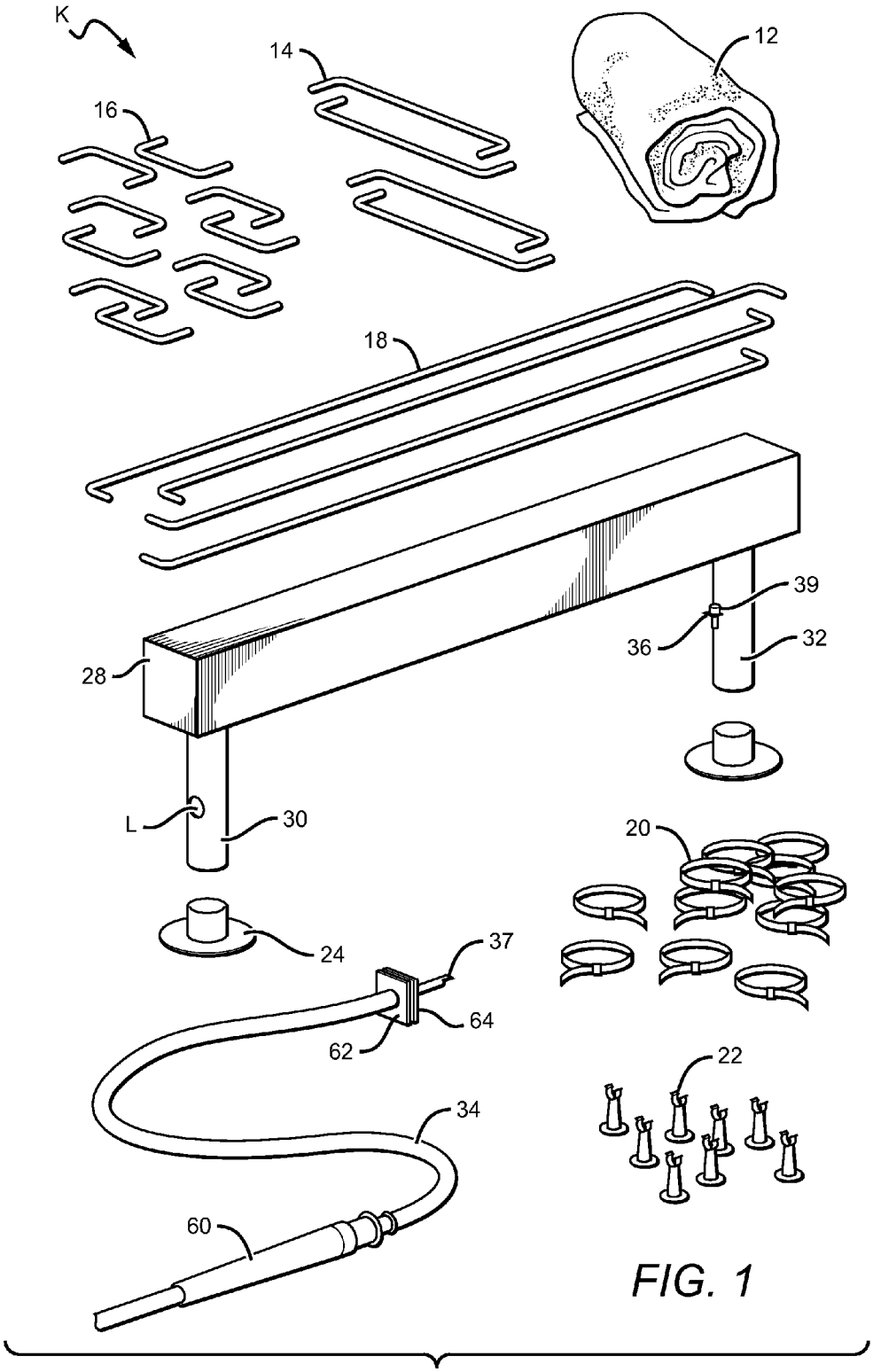
FIG. 1 is an exploded view of the contents of a kit for fabricating an anode sled.

FIG. 1 illustrates the contents of a kit K to fabricate the anode sled and operably connect the anode to an underwater structure for cathodic protection. Kit K includes a compacted bag 12, a plurality of supports of various lengths 14, 16, 18, a plurality of tie rods 20, a plurality of rod chair stands 22, post supports 24, an anode 28 having integral posts 30 and 32 for attachment to a respective post support 24, and a cable 34 for operably connecting anode 28 to an underwater metallic structure (not shown). Cable 34 can include a bend stiffener/restrictor (BSR) 60 and armor wire restraining plates 62 and 64.

FIG. 2 shows the anode sled 10 assembled and ready for operable connection to an underwater metallic structure.

Figure 8:
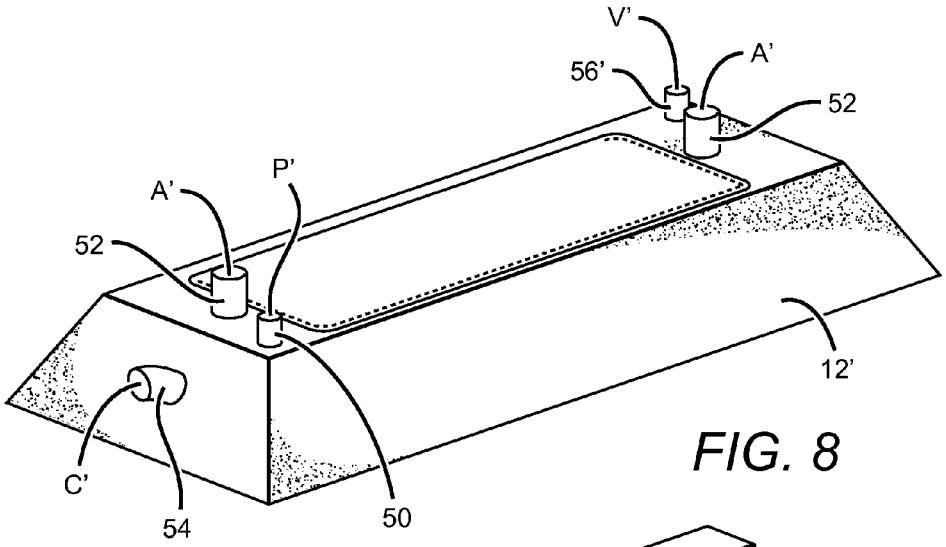
FIG. 8 is an illustration of a first alternative embodiment where each hole has a respective elephant trunk for tie-down purposes.
Figure 9:
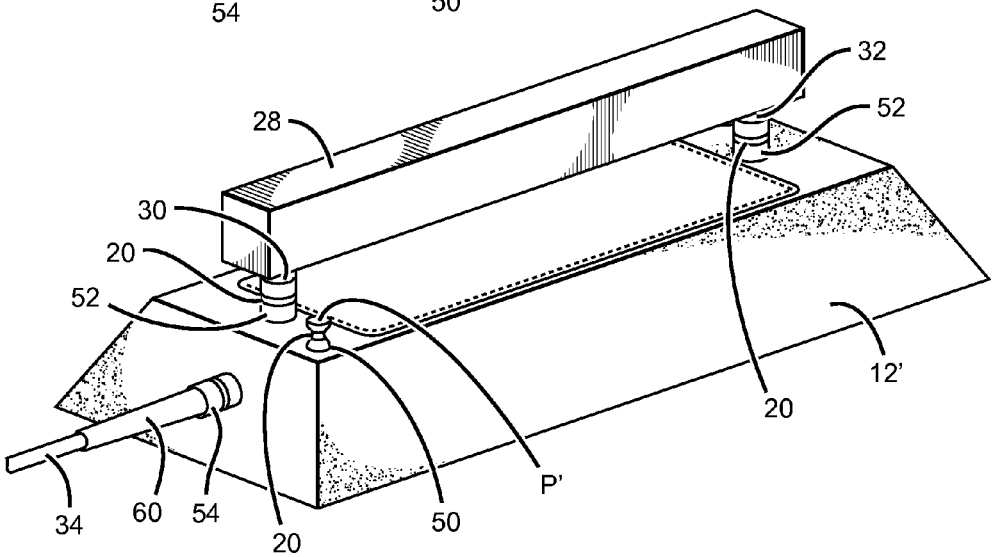
FIG. 9 illustrates FIG. 8 fully assembled.

FIG. 3 generally shows how the exterior of bag 12 appears when filled. Bag 12 comprises a closeable opening O which can be closed when flap 26 is zippered to the adjacent top surface; post apertures A for receiving posts 30 and 32; port P for filling bag 12 with ballast and hole C for cable 34 to pass through. In a slightly modified embodiment represented by FIG. 8, elephant trunks 50, 52, 54, and 56 extend from bag 12 for port P', post apertures A', hole C' and vent V' respectively. Tie-rods 20 are used to facilitate closure and prevent ballast seepage as illustrated in FIG. 9.

Figure 5:
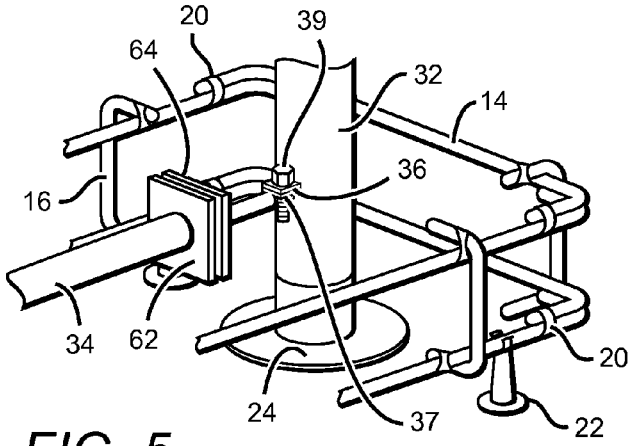
FIG. 5 illustrates one embodiment for connection of a cable.

FIG. 4 illustrates the assembled skeletal structure depicted generally as 13 using the parts shown in FIG. 1. Tie rods 20 (not shown in FIG. 4), can be used for securing adjoining parts to one another as illustrated in FIG. 5. Parts 14, 16, 18 and 22 can be made either from a metal such as steel or any rigid non-metallic material such as fiberglass. This skeletal structure is positioned within the bag through opening O when zippered flap 26 is separated from the adjacent top surface of bag 12 as shown in FIG. 3. Apertures A are sized to permit the lower portion of posts 30 and 32 to extend through and down into attachment with a respective post support 24.

Post 30 has aperture L which allows cable 34 to pass through. As can best be seen in FIG. 5, post 32 includes a lug 36 for mating to lug 37, which is attached to the proximal end of cable 34, using bolt 39 for operably connecting cable 34 to anode 28.

Figure 6:
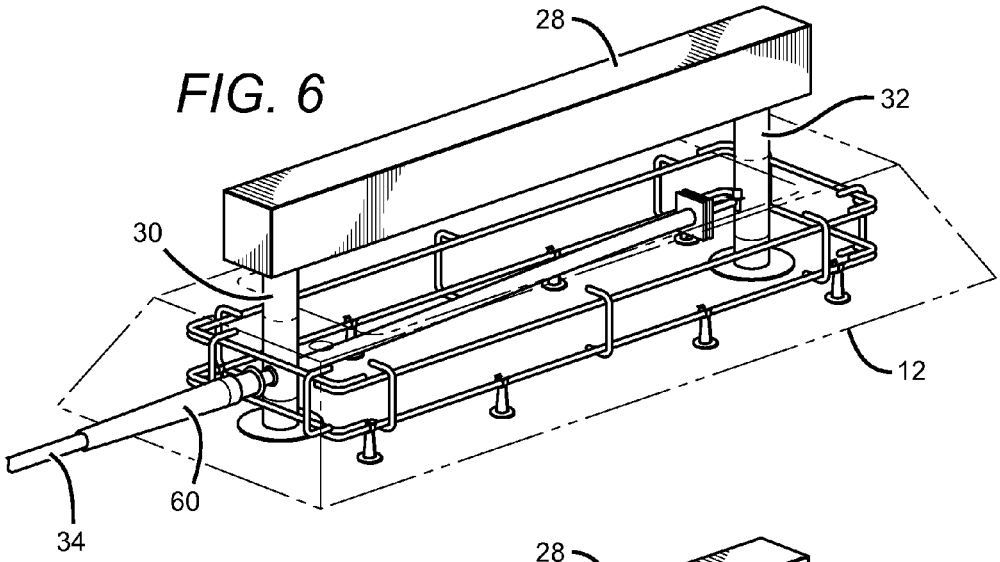
FIG. 6 illustrates the structural support within the bag and cable connection

FIG. 6 illustrates the general configuration of skeleton 13, cable 34 and posts 30 and 32 connected with post supports 24 in bag 12 after zippered flap 26 closes opening O.

Figure 7:
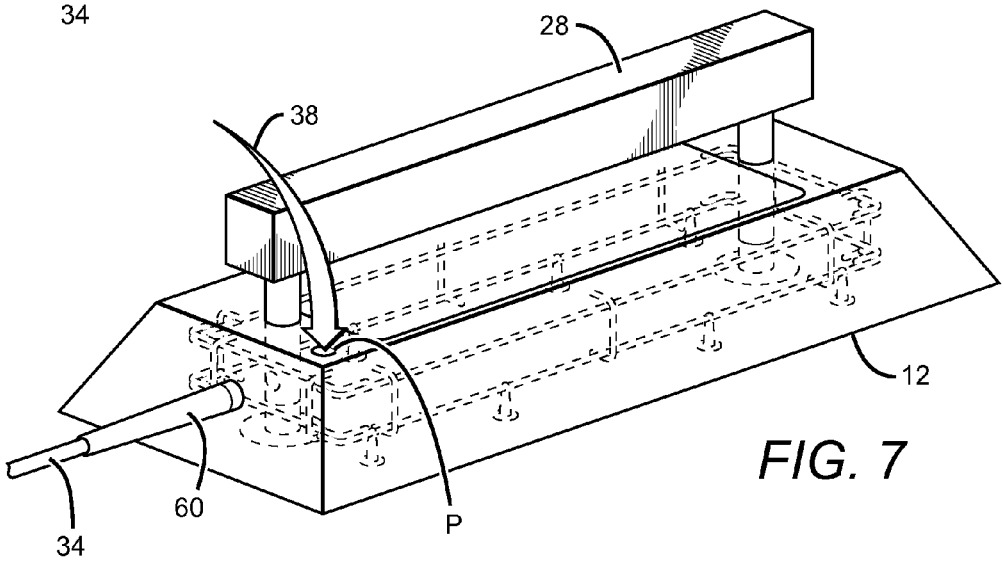
FIG. 7 illustrates an input port embodiment of the sled bag for filling with ballast.
Figure 10:
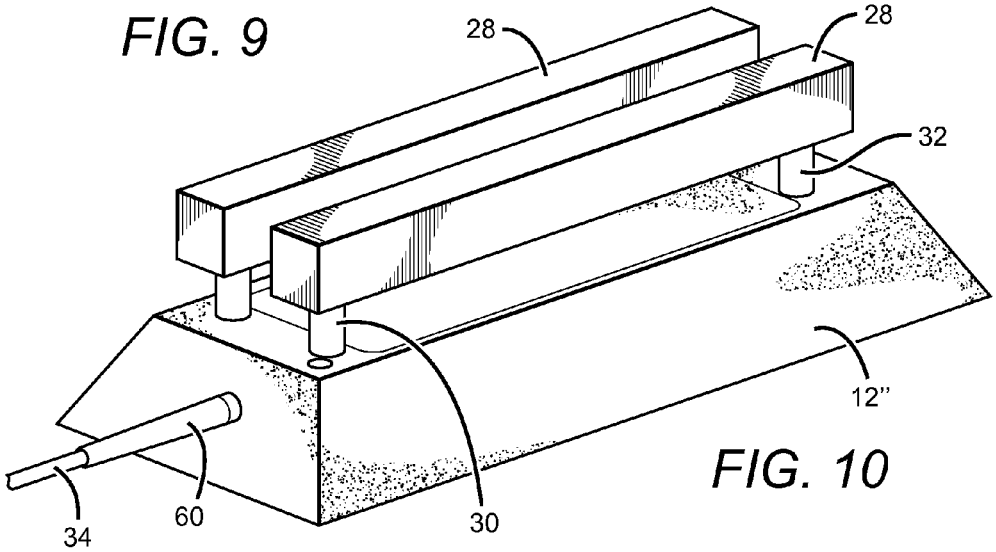
FIG. 10 is an illustration of a second alternative embodiment showing a pair of anodes supported by the sled.

FIG. 7 illustrates port P used to pump ballast 38 into bag 12. FIG. 10 illustrates an alternative embodiment for supporting a pair of anodes. Bag 12" has 4 apertures for receiving two pair of posts 30 and 32 where each pair supports a respective anode 28. Cable 34 can be junctioned within bag 12" for operably connection to each anode 28.

It will be understood that either impressed current or sacrificial anode systems can utilize my sled design. The figures described in this section were directed to a sacrificial anode system. The only difference in assembly of my sled design between the systems is that for impressed current cathodic protection, the physical cable connection to anode 28 at lugs 36, 37 and bolt 39 is preferably encased in urethane or similar product to prevent water intrusion.

With my sled design described, the method of assembly is as follows:

Kit K is provided having a bag in a compacted condition, component parts for constructing a skeletal structure to be disposed within the bag, an anode integrally connected to at least one post having a lower end for insertion through a respective post aperture formed on the top surface of the bag, and a cable having a pre-determined length, a proximal end and a distal end. The cable length can be ordered ahead of time or supplied as a separate item once the required cable length is determined.

The bag is then uncompacted; meaning unrolled or unfolded to place the bag in a condition for receiving the assembled skeletal structure 13 which is inserted into the bag through the closable opening O. Next, post supports 24 are placed within the bag with posts 30 and 32 being inserted through the post holes A located on the top surface of the bag into engagement with post supports 24. The proximal end of cable 34 having lug 37 is operatively connected to anode 28 by mating to lug 36 using bolt 39. Armor wire restraining plates 62 and 64 are utilized near the proximal end to provide strain relief using well known methods.

In one embodiment, cable 34 can be shipped with restraining plates 62 and 64 attached to lug 37 and during the assembly process, the distal end of cable 34 would be run through aperture L and cable hole C. In another embodiment, cable 34 can be shipped with restraining plates 62 and 64 unassembled and during assembly, the proximal end of cable 34 would be run through cable hole C and aperture L and then assembled to restraining plates 62 and 64 for operable connection to anode 28.

Once cable 34, BSR 60, post supports 24 and posts 30 and 32 are in position, flap 26 is zippered closed. If the bag design incorporates elephant trunks such as those shown in FIG. 8, trunks 52 and 54 are now closed using tie rods 20. Ballast is now pumped into the bag through port P' and air within the bag escapes through vent V'. Once the bag is filled with ballast, tie rods 20 are used to seal about elephant trunks 50 and 56. The ballast is allowed to cure and thereafter, the fully assembled anode sled can be lowered to a pre-determined position on the sea floor and operatively connected to an underwater structure requiring cathodic protection.

I claim:

1. An anode sled for providing cathodic protection to an underwater metallic structure comprising:

a bag having an internal space previously in a compacted condition, said bag having a top surface, a closable opening of sufficient size for insertion of a skeletal support structure, at least one aperture located on said top surface for receiving through a respective post, and an opening for introducing ballast wherein said opening is either said closable opening or a separate inlet port;

a skeletal support structure disposed within said bag, wherein after said skeletal support structure is disposed within said bag said closable opening is closed;

at least one post having a base within said bag and a top portion extending upward through said at least one aperture;

an anode connected to the top portion of said at least one post;

a cable having a proximal end and a distal end, said proximal end operatively connected to said anode; and said ballast filling the remaining internal space of said bag.

2. The anode sled of claim 1 for providing impressed current cathodic protection to an underwater metallic structure.

3. The anode sled of claim 1 for providing sacrificial anode cathodic protection to an underwater metallic structure.

4. The anode sled of claim 1 further comprising a port for venting air from said bag while said bag is being filled with said ballast.

5. The anode sled of claim 1 further comprising a separate second opening for said cable to extend through.

6. The anode sled of claim 1 where said cable has a pre-determined length and said distal end can be operatively connected to an underwater metallic structure.

7. The anode sled of claim 1 further comprising a second anode operatively connected to said cable.

8. The anode sled of claim 1 where said anode is integrally connected to the top portion of said at least one post.

9. A kit for constructing an anode sled comprising:

a bag having an internal space in a compacted condition, said bag having a top surface, a closable opening of sufficient size for insertion of a skeletal support structure, at least one aperture located on said top surface for receiving through a respective post;

hardware for assembly of said skeletal support structure for positioning within said bag;

an anode integrally connected to said at least one post having a base portion for insertion through a respective said at least one aperture, where said base portion is positioned within said bag and;

where said kit is used to form an anode sled on-site when the bag is uncompacted and the internal space of said bag is filled with ballast after said skeletal support structure and said base portion is positioned within said bag.

10. The kit of claim 9 further comprising a cable having a proximal end and a distal end, said proximal end for operatively connecting to said anode.

11. The kit of claim 9 where said bag further comprises elephant trunks extending outward from said inlet port, said outlet port and said cable opening and respective tie rods.

12. A method for assembly and use of an anode sled comprising the steps of:

providing a bag in a compacted condition, said bag having a top surface, a closable opening of sufficient size for insertion of a skeletal support structure, at least one post aperture located on said top surface for receiving through a respective post, an inlet port on said to surface for filling said bag with ballast, a venting port, and a cable opening for a cable to extend through;

providing a skeletal structure to be disposed within said bag;

providing an anode integrally connected to at least one post having a lower end for insertion through a respective said aperture;

providing a cable having a pre-determined length, a proximal end and a distal end uncompacting said bag;

inserting said skeletal structure through said closable opening into said bag;

inserting said at least one post through a respective said post aperture;

inserting the proximal end of said cable through said cable opening into said bag;

operatively connecting the proximal end of said cable to said anode;

closing said closable opening;

filling said bag with ballast through said inlet port;

allowing said ballast to cure; and thereafter, positioning said anode sled underwater.

13. The method of claim 12 where said ballast is concrete.

14. The method of claim 12 where said step of positioning said anode sled comprises:

lowering said skeletal structure, said anode, said at least one post, said cable having a pre-determined length, and said ballast to a pre-determined position on the sea floor; and operatively connecting the distal end of said cable to an underwater metallic structure requiring cathodic protection.

* * * * *